United States Patent [19]

Brierley

[11] Patent Number: 4,729,417

[45] Date of Patent: Mar. 8, 1988

[54] POP UP CHANGE PURSE

[76] Inventor: Gladys Brierley, R.R. #1, Yarker, Ontario, Canada, K0K 3N0

[21] Appl. No.: 1,855

[22] Filed: Jan. 9, 1987

[51] Int. Cl.[4] ..... A45C 1/02; A45C 3/02; A45C 3/06; A45C 13/10

[52] U.S. Cl. ..... 150/116

[58] Field of Search ..... 150/111-117

[56] References Cited

U.S. PATENT DOCUMENTS

| | | | |
|---|---|---|---|
| D. 89,545 | 3/1933 | Jahncke | 150/117 X |
| 302,071 | 7/1884 | Weintrand . | |
| 1,939,657 | 12/1933 | Brosseau | 150/115 |
| 2,111,079 | 5/1938 | Spear et al. . | |
| 2,503,501 | 4/1950 | Lutz | 150/112 X |
| 2,984,278 | 5/1961 | Siletti | 150/116 |
| 3,831,651 | 8/1974 | Leahy | 150/111 X |
| 4,257,463 | 3/1981 | Monaco | 150/112 X |

*Primary Examiner*—William Price
*Attorney, Agent, or Firm*—Donald E. Hewson

[57] ABSTRACT

A change purse is provided with a suspension device for attaching the purse within the mouth of a ladies purse, below the closure zipper thereof, the suspension device being connected with the closure zipper for actuation thereby as the zipper is opened, to move the change purse in upwardly presented relation above the closure zipper. The arrangement is particularly suited to two handed operation by the user, namely, the holding of the ladies purse in one hand and the manipulation of the zipper, the presentation of the change purse and accessing into the change purse, with the other hand. The arrangement also contemplates the incorporation with the change purse of articles requiring rapid or automatic presentation, such as rapid access to nitroglycerine medication by a heart patient; rapid access to charge cards by a user, the accessing of keys or eye glasses in their cases or automatic presentation to alert a stranger of a medic-alert tag or other form of emergency identification. The invention also is susceptible of use with a brief case, wherein the re-orientation displacement takes place as a consequence of frictional forces acting on the inserted container, from contact made with the inner wall surface of the containing, soft sided hand luggage within which the inserted container is lodged.

10 Claims, 4 Drawing Figures

POP UP CHANGE PURSE

BACKGROUND OF THE INVENTION

This invention is directed to a change purse, and more particularly to a change purse incorporating a linkage for mounting a change purse within a hand purse.

In their predominant environment of use, within ladies hand purses, change purses present a long standing need. The presence of a change purse often requires the owner of the hand purse within which it is lodged to place the hand purse down on a working surface, in order to locate and retrieve the change purse. Under more normal conditions, when the change purse comes readily to hand, it is often necessary to transfer the hand purse from the owner's hands to being gripped beneath the arm, while opening up and obtaining the required coinage or other article from within the change purse. In these uncertain times in many urban societies, such hap-hazard handling of ones valuables is tantamount to an invitation to be robbed. At the least, the problems presented in handling a hand purse and a change purse prove often to be both an embarrassment, an annoyance and a great waste of time.

One very early attempt to come to grips with these problems, U.S. Pat. No. 302,071, ROBERT WEINTRAND, issued July 15, 1884, shows a change purse suspended from within a clasp-type ladies hand purse by means of a special support hook.

In SPEAR et al, U.S. Pat. No. 2,111,079, issued May 15, 1938, there is shown a hand purse having a plurality of securing clips slideable across the mouth of the purse in adjustable closing relation therewith. Movement of clips to one end of the purse mouth provided access to the interior thereof. Movement in the opposite, closing direction of a selected one of the closure clips, tended to tension a pull cord, to eject a mirror upwardly out of its pouch, for use by the owner.

In accordance with the present invention a change purse is provided with a suspension device for attaching the change purse within the mouth of a ladies zippered hand purse. The change purse is connected by a suspension device with the hand purse zipper draw for actuation thereby, so that retraction of the zipper draw in a purse opening mode causes the change purse to be oriented into an upward facing substantially level, raised relation within a respective compartment of the hand held purse, to provide one-handed access thereto, the change purse being held in resilient readied relation by the adjacent sides of the hand purse.

The relationship between the length of the suspension device and its point of attachment to the side of the change purse may be such that actuation to a fully operative position can raise the mouth of the change purse above and clear of the mouth of the hand purse.

In addition to facilitating the use of their change purse by an individual, the subject arrangement has certain obvious safety factors associated therewith. Thus, the change purse or its equivalent can carry a key or keys, such as car keys, latch keys etc., whereby delays that can otherwise prove inconvenient,and in certain circumstances even dangerous to the user may be readily avoided.

Furthermore urgent medication and/or notice relating thereto, such as a Medic Alert (TM) label or bracelet can be mounted upon the change purse or its equivalent, so as to come immediately to hand for a person lending necessary assistance to the user of the purse, in an emergency. Similarly a charge or security access card can be safely stowed for rapid access by the user.

Furthermore, the location of the change purse in oriented relation at or adjacent the top of the hand purse compartment,underlying the zipper, can optimize utilization of the lower portion of that compartment, while maintaining the change purse readily accessible in its own location.

In one embodiment,the change purse suspension means includes a hook means securing one end of the subject tilt link to the change purse.

A further embodiment of the tilt link means incorporates a detachable ball secured to the end of the link remote from the change purse, the ball being connected through an aperture in the zipper draw of the hand purse to which the change purse is secured. The ball facilitates trouble free operation of the change purse upon its tilt link.

In yet another embodiment, in addition to its respective fastening means, one tilt link incorporates a braided thong of predetermined length. In an alternative embodiment, a rigid link is utilized.

The presence of miscellaneous contents such as change within the change purse, and the usual location of its point of suspension above the centre of gravity and above the centre of contents of the change purse, assures that in its "parked" condition when the zipper of the hand purse is closed, the change purse will hang in an inclined relation within the compartment of the hand purse.

In use it has been found that the operation of the hand purse/change purse combination does not function as might be expected, and in fact selectively different interactions can be achieved.

Thus, on moving the zipper of the hand purse, having the subject change purse in suspended relation therebeneath, the friction against the sides of the change purse from the adjoining sides of the hand purse compartment walls creates a torque about the point of suspension, which drives the change purse in an upward, turning motion, to present it in the opening mouth of the hand purse, immediately adjacent the user's hand which is operating the hand purse zipper. Thus, it is quite feasible to access the change purse in its raised condition without fully opening the zippered mouth of the hand purse.

The discovery of this frictional drive mode of operation enables the present invention to be utilized with brief cases and other soft sided hand luggage.

Alternatively, the automatic raising up of the change purse or other insert container can be readily "suppressed" by the user, permitting a fairly complete opening of the hand purse without the change purse coming into clear view. Further displacement of the main zipper to the fully open position will then display the change purse in a mechanically raised position, brought about by interaction of the heel of the change purse in abutting relation with the end of the "parent" hand purse.

While the subject arrangement is operative for a range of lengths of the change purse tilt link, for most practical purposes the adoption of a tilt link of about 2 cm ($\frac{3}{4}$ inch) effective length has proved very useful.

BRIEF DESCRIPTION OF THE DRAWINGS

Certain embodiments of the invention are described, reference being made to the accompanying drawings, wherein.

DETAILED DESCRIPTION OF THE EMBODIMENTS

Figure 1:
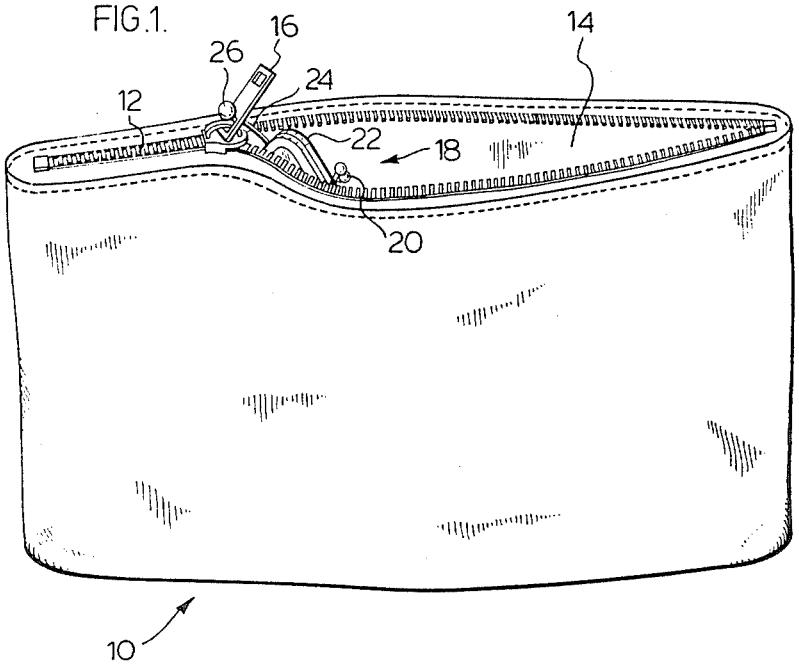
FIG. 1 is a general side view of a hand purse incorporating a change purse in accordance with the present invention.

Referring to FIG. 1, a hand purse 10 has a zipper 12 across the mouth 14 thereof. The zipper 12 has a hand draw 16. A subject change purse 18, of which the clasp 20 and frame 22 may be seen, is tethered by tilt link 24 to the zipper draw 16, by way of a ball 26. The connection extends through an aperture (see FIG. 3) in the zipper draw 16.

Figure 2:
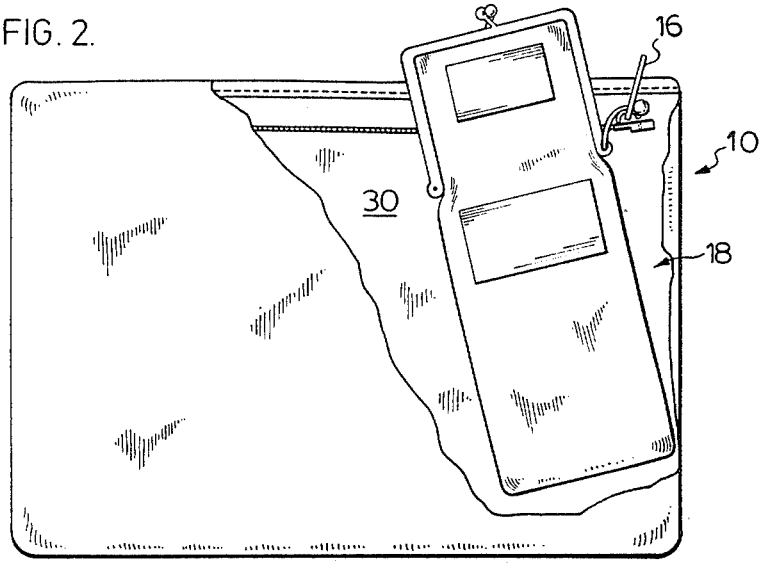
FIG. 2 is a side view of another embodiment, having the near side of the hand purse partly torn away.

Referring to FIG. 2, there is shown a hand purse 14 having a change purse 18 oriented into upwardly facing relation, having the upper portion thereof projecting upwardly out of the compartment 30 of the hand purse.

The presence of a Medic Alert (TM) notice, and a credit card are indicated, as a further showing of the utility of the subject arrangement.

As above stated, the utilization of the subject arrangement with a single key, or a plurality of keys in a key repository or other suitable key mounting arrangement, with or without a change purse per se also is considered to fall within the ambit of this invention.

Figure 3:
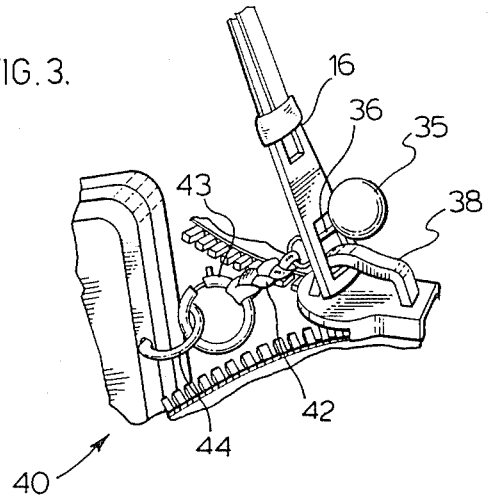
FIG. 3 is a detail of a change purse suspension linkage embodiment.
Figure 4:
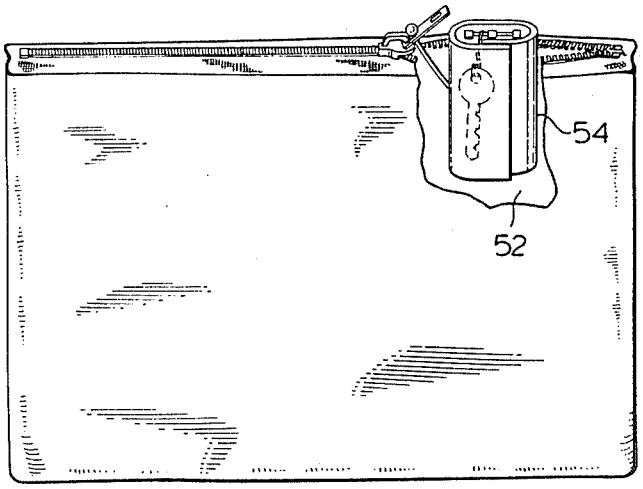
FIG. 4 is a side view showing the present invention in use with a key container, within a brief case, having a near side portion torn away.

Referring to FIG. 3, it will be seen that a toggle ball 35 having an attachment spindle and eye 36 mounts very conveniently on the portion 38 of a zipper draw, in the fashion illustrated. A portion 40 of a change purse shows the tilt link 42, in this case a woven toggle 42, connected by way of an eye 44 and spring loaded release link 43 to the change purse 40.

The foregoing disclosure is made in regard to the use of a suspended container, a ladies hand bag or, as referred to herein, a "hand purse" as distinct from the smaller change purse which comprises the disclosed suspended container. However, the advantages of the invention also may be applied to other small containers that are thereby suspended, such as key ring holders, eye glass cases and the like, which may be suspended by the subject suspension means.

Furthermore, the suspended small container may be used in conjunction with larger receptacles than hand purses such as the zippered brief case, wherein the texture of the brief case wall inner surface 52 imparts sufficient frictional drag upon the suspended case 54 so as to cause re-orientation of the suspended case into a substantially upright position, without essentially coming into pivotal contact with an end wall of the outer receptacle.

What is claimed is:

1. In a change purse having a container for the elective insertion and removal of articles therefrom, said change purse being useable in co-operation and within a hand purse, said container having a pair of opposing sides in joined relation about the edges thereof to form the container and bounded by an elongated mouth joinable in closing relation therebetween, the improvement comprising suspension means attached to an edge portion of the change purse adjacent and below the mouth; said suspension means including a tilt link for attachment, in use, by one end of the link to the zipper draw of said hand purse, to locate said change purse in oriented relation within a compartment of said hand purse, beneath the zipper thereof, to enable one handed operation of said zipper in opening manipulation of said zipper draw to open said hand purse compartment; wherein said tilt link displaces said change purse in upward tilting relation relative to said zipper draw, to present said change purse oriented in stabilized, substantially level, raised relation within said hand purse compartment, for one handed access to the contents of the change purse.

2. The change purse as set forth in claim 1, said suspension means including hook means securing one end of said tilt link to said change purse.

3. The change purse as set forth in claim 1, said suspension means including detachable ball means removeable from said tilt link for re-attachment thereto in connecting relation through an aperture in said zipper draw, in use to suspend said change purse in supported relation by said ball means from said zipper draw.

4. The change purse as set forth in claim 2, said tilt link including an intermediate flexible, braided member of predetermined length.

5. The change purse as set forth in claim 2, said tilt link including an intermediate rigid link member of predetermined length.

6. In combination, a suspension device and an insert container selected from the group comprising change purses, key containers, glass cases and the like, for individual transport within soft sided hand luggage such as brief cases, hand purses and the like, having a zipper closure extending across a compartment of said hand luggage, said zipper closure including an actuator therefor having a draw portion;

said insert container comprising an enclosure casing having an access opening for the contents thereof;

said suspension device being of predetermined length and having first attachment means for the attachment thereof to a selected said insert container at a point along one side thereof a predetermined distance from a selected end of the insert container, second attachment means at the end of said suspension device opposite said first attachment means, for releasably attaching said insert container to said zipper closure draw portion; whereby, in use, said insert container is releasably secured to said zipper draw portion by way of said suspension device, to hang therebeneath within a compartment of said hand luggage, and to pivot upwardly in re-oriented upward facing presentation to a position adjacent said closure upon displacement of said zipper closure in an opening direction.

7. The combination as set forth in claim 6, said insert container being freely suspendable within said hand luggage.

8. The combination as set forth in claim 6, said insert container being of a sufficient length to readily contact an end of said hand luggage compartment, for pivoting upwardly in said re-oriented presentation.

9. The combination as set forth in claim 6, said insert container being of relatively reduced length, whereby in use said operation of pivoting upwardly in re-oriented upward facing presentation takes place as a consequence of frictional forces from a side wall portion of said hand luggage acting on said insert container, to generate a righting torque thereagainst, acting about said suspension device.

10. The combination as set forth in claim 6, wherein the effective length of said suspension device, in relation to said predetermined distance, effectively presents said insert container closure in re-oriented raised relation above the level of said zipper closure.

* * * * *